US007955450B2

(12) United States Patent
Mahlo et al.

(10) Patent No.: US 7,955,450 B2
(45) Date of Patent: Jun. 7, 2011

(54) METHOD FOR HEAT TREATMENT

(75) Inventors: Thomas Mahlo, Geretsried (DE); Gerd Waning, Bad Salzuflen (DE)

(73) Assignee: Linde Aktiengesellschaft (DE)

( * ) Notice: Subject to any disclaimer, the term of this patent is extended or adjusted under 35 U.S.C. 154(b) by 627 days.

(21) Appl. No.: 11/732,317

(22) Filed: Apr. 3, 2007

(65) Prior Publication Data

US 2007/0251612 A1 Nov. 1, 2007

(30) Foreign Application Priority Data

Apr. 4, 2006 (DE) ..... 10 2006 015 739
Jul. 27, 2006 (EP) ..... 06015702

(51) Int. Cl.
*C22F 1/16* (2006.01)
*C23C 8/00* (2006.01)

(52) U.S. Cl. ..... 148/708; 148/206; 148/225; 148/235; 148/712; 148/713; 432/176; 432/196; 432/199

(58) Field of Classification Search ..... 432/19, 432/21, 24, 25, 176, 196, 199, 246; 148/712, 148/713, 206, 225, 235, 708
See application file for complete search history.

(56) References Cited

U.S. PATENT DOCUMENTS

| | | | | |
|---|---|---|---|---|
| 4,191,525 | A | 3/1980 | Sallman | |
| 4,354,827 | A | 10/1982 | Kissel | |
| 5,795,146 | A | 8/1998 | Orbeck | |
| 2004/0173608 | A1 * | 9/2004 | Seccombe et al. | 219/762 |

FOREIGN PATENT DOCUMENTS

| | | |
|---|---|---|
| EP | 0 075 438 | 3/1983 |
| EP | 0 355 520 | 2/1990 |
| EP | 1 004 837 | 5/2000 |

OTHER PUBLICATIONS

EPO Search Report; conducted in Munchen on Sep. 20, 2006.

* cited by examiner

*Primary Examiner* — Stanley Silverman
*Assistant Examiner* — Brian Walck
(74) *Attorney, Agent, or Firm* — Joshua L. Cohen

(57) ABSTRACT

The invention relates to a method for the heat treatment of workpieces in a heat treatment furnace, wherein the treatment atmosphere in the heat treatment furnace is circulated. According to the invention, a propellant is injected into the heat treatment furnace in such a manner that the treatment atmosphere is essentially circulated by the injected propellant.

16 Claims, No Drawings

METHOD FOR HEAT TREATMENT

CROSS-REFERENCE TO RELATED APPLICATION

This application claims priority under 35 U.S.C. §119 to German Patent Application No. DE 102006015739.7, filed in the German Patent and Trade Mark Office, the disclosure of which is incorporated by reference herein in its entirety.

FIELD OF THE INVENTION

1. Field of the Disclosure

The invention relates to a method for the heat treatment of workpieces in a heat treatment furnace, wherein a propellant is injected directly into the heat treatment furnace by means of at least one propellant nozzle and the treatment atmosphere in the heat treatment furnace is circulated.

2. Description of the Related Art

The treatment atmosphere is circulated by means of ventilators in many heat treatment furnaces so as to improve the homogeneity of the atmosphere within the furnace system. It is furthermore possible to achieve therewith a more rapid material exchange between the furnace atmosphere and the heat treatment commodity. Without a circulation of the treatment atmosphere, high inhomogeneities would materialize in the treatment atmosphere.

Operation, maintenance and repair of these ventilator systems often cause considerable costs for the operator of the furnace systems. Unbalances at the ventilators can also cause vibrations in the heat treatment furnace. These vibrations can damage the furnace construction, for example, mufflers, retorts, heating elements or the brick lining.

A continuous furnace is known from EP 0 355 520 B1, where a defined gas flow in or opposite to the passage direction of the treatment commodity, i.e., parallel to the longitudinal direction of the furnace, is generated by injecting the treatment gas into the cooling section of the continuous furnace. In an embodiment, the gas flow is thereby oriented in such a manner that the advancement of leak air at critical locations is avoided as much as possible.

Even though the use of this known method generates a main flow direction in the furnace, a circulation of the atmosphere itself does not take place. This means that the homogeneity of the atmosphere in the interior of the furnace is not increased. On the contrary, the gas flow generates a specific decline in concentration in the furnace.

It is therefore desirable to provide a method for heat treatment, which avoids as much as possible the problems connected with the circulation of the treatment atmosphere by means of ventilators.

SUMMARY OF THE INVENTION

In an embodiment, the present invention provides a method of the above-mentioned type, wherein the workpieces are heat-treated in the treatment atmosphere at a temperature of above 600° C., and the propellant is injected into the heat treatment furnace in such a manner that the treatment atmosphere is essentially circulated by means of the injected propellant and inhomogeneities in the treatment atmosphere are reduced and that devices for guiding the treatment atmosphere to the propellant nozzle are not provided in the heat treatment furnace. In an embodiment, the workpieces are heat-treated in the treatment atmosphere at a temperature of above 750° C.

DETAILED DESCRIPTION OF PREFERRED EMBODIMENTS

As described above, EP 0 355 520 B1 proposes to improve the heat transfer in the cooling section of a continuous furnace in that a directed gas flow is generated in the cooling section by injecting a treatment gas. The workpieces are thereby cooled from temperatures of approximately 300° C. to approximately 100° C., for example. With temperatures of below 600° C., the convective portion prevails during the heat transfer. With the process proposed in EP 0 355 520 B1, the convection is intensified and an improved cooling is thus achieved.

The instant invention, however, is directed to the heat treatment of workpieces at temperatures of above 600° C. In another embodiment, the heat treatment of workpieces is at temperatures of above 750° C. In these temperature ranges, the heat transfer is essentially performed by means of radiation. The convection contributes only insignificantly to the improvement of the actual heat transfer.

With respect to heat transfer, an intensified circulation of the treatment atmosphere is thus not necessary. The invention is now based on the realization that a circulation of the treatment atmosphere indeed provides advantages with regard to the material transfer, i.e., the thermochemical interaction between the treatment atmosphere and the workpieces.

An intensive circulation of the treatment atmosphere and an improved mixture of all of the components of the treatment atmosphere can be achieved by means of a high-speed injection of a propellant. The different reaction-ready media in the treatment atmosphere can thus find their reaction partner more rapidly and the heat treatment proceeds faster and more evenly. The intensity of the material exchange is intensified with the increase of the speed of the treatment atmosphere at the workpiece surface according to an embodiment of the invention.

According to an embodiment of the invention, propellant is radiated into the heat treatment furnace. The radiation locations and the radiation directions of the different propellant jets are chosen in such a manner that the best possible circulation of the treatment atmosphere occurs in the heat treatment furnace. With a suitable configuration of the propellant nozzles provided for the radiation of the propellant, additional measures for circulating the treatment atmosphere may not be necessary.

According to an embodiment of the invention, the propellant is injected directly into the heat treatment furnace. The propellant nozzles for injecting the propellant are disposed in the side walls or in the roof or the cover of the heat treatment furnace and the propellant is radiated directly into the interior of the furnace. The discharge opening of the propellant nozzle ends directly in the heat treatment furnace. To refit an existing furnace, it is only necessary to install the propellant nozzles at suitable locations in the walls or in the cover of the furnace and to apply propellant thereto.

Fixtures or devices for the compulsory guide of the treatment atmosphere in the direction of the propellant nozzle(s) are not provided in the interior of the furnace. In particular, the propellant is not injected into pipes or pipe pieces, in which a low pressure is to be generated, so as to suck in treatment atmosphere into the pipe pieces according to the water-jet pump principle and to thus achieve a circulation of the treatment atmosphere.

In line with the invention, it has become known that a flow profile can be generated by injecting the propellant with a high speed, said flow profile taking in, carrying along and circulating large quantities of treatment atmosphere. According to an embodiment of the invention, it is thus not necessary to provide elaborate installations in the heat treatment furnace. Already existing heat treatment furnaces can thus easily be converted to the method according to the invention.

The atmosphere in the heat treatment furnace may be circulated by means of the injected propellant. Ventilators, which are presently used for this purpose, are not necessary. The invention thus represents a largely maintenance-free replacement for the current ventilator systems. The costs for maintenance and repair can be lowered considerably.

In an embodiment of the present invention, the propellant is injected at right angles to the longitudinal direction of the heat treatment furnace. The above-mentioned method according to EP 0 355 520 B1 can only be used in the cooling zone of the continuous furnace, but not in the actual furnace chamber. The cooling zone is relatively long, but has only a very small width so that a longitudinal flow is easy to generate. However, the furnace or treatment chamber, where the actual heat treatment takes place, is considerably higher and has numerous fixtures. Furthermore, the atmosphere in the treatment chamber has a different composition, in particular a higher viscosity. Due to these factors it would be difficult to cause a defined longitudinal flow in the treatment chamber by means of the method according to EP 0 355 520 B1. Circulation of the atmosphere and a decrease or elimination of inhomogeneities in the treatment atmosphere is not achieved with the orientation of the gas flow proposed therein.

In an embodiment of the present invention, the propellant is thus injected at right angles to the longitudinal direction of the furnace, i.e., in a continuous furnace at right angles to the passage direction of the workpieces, which are to be treated. In an embodiment, the angle between the injection direction of the propellant and the longitudinal direction of the furnace is above 45°. In another embodiment, the longitudinal direction of the furnace is above 60°. In yet another embodiment, the longitudinal direction of the furnace is above 80°. In so doing, atmospheric circulations are caused, which do not extend across the entire interior of the heat treatment furnace, but which are limited to certain partial regions. A largely homogenous atmosphere is generated in these partial regions and, due to the circulation, the interaction between the treatment commodity and the atmosphere is intensified.

It has become evident that a good circulation of the furnace atmosphere can be achieved with a suitable configuration of the propellant nozzles, even at angles of between 15 and 40°. In another embodiment, good circulation of the furnace atmosphere can be achieved with a suitable configuration of the propellant nozzles between 20 and 35°. In yet another embodiment, good circulation of the furnace atmosphere can be achieved with a suitable configuration of the propellant nozzles between 25 and 30°.

In an embodiment, the propellant is injected into the heat treatment furnace with a high speed. This speed can of above 50 m/s. In another embodiment, this speed can be faster than the speed of sound. Due to the high exit speed of the propellant, the atmosphere, which surrounds the propellant nozzle and the propellant jet, is carried along and the desired intensified circulation and thus the elimination of inhomogeneities is achieved in the treatment atmosphere.

In an embodiment of this invention, the propellant nozzle is designed in such a manner that the ratio of injected propellant quantity to the carried-along gas quantity becomes as high as possible. In an embodiment, the ratio of injected propellant quantity to the carried-along gas quantity is between 1 to 10 and 1 to 60. In yet another embodiment, the propellant is injected into the heat treatment furnace in such a manner that the ratio of the volumes of circulated treatment atmosphere to inserted propellant is greater than 20. In yet another embodiment, the propellant is injected into the heat treatment furnace in such a manner that the ratio of the volumes of circulated treatment atmosphere to inserted propellant is greater than 25. In a roller hearth furnace, for example, more than 1000 $m^3/h$ of treatment atmosphere can thus be circulated by means of only four propellant nozzles according to the invention, to each of which 10 $Nm^3/h$ of propellant is applied.

In an embodiment, the propellant is injected into the heat treatment furnace with a pressure of between 2 and 20 bar. In another embodiment, the propellant is injected into the heat treatment furnace with a pressure of between 2 and 10 bar. It has become evident that the selection of high pressures also leads to an even distribution of the treatment atmosphere.

Likewise, a pulsed introduction of the propellant has proven itself.

In an embodiment, gaseous nitrogen is used as propellant. Nitrogen has an advantage that it can already be found or must be supplied as an inert component in most of the treatment atmospheres. The nitrogen pressure, which is free of charge in these cases, is used for moving the treatment atmosphere.

As a matter of principle, however, it is also possible to inject air as propellant. In this connection it must be considered to keep the injected air quantity in a sensible proportion to the entire quantity of protective gas as well as the other supplied media, such as hydrocarbons, for example.

As a rule, a heat treatment furnace has different furnace zones, for example an inlet zone, the actual treatment chamber in which the treatment commodity is subjected to a defined atmosphere under defined conditions and a cooling and outlet zone. The invention is particularly suitable for circulating the atmosphere in the treatment chamber of a heat treatment furnace.

The invention may be used in the most different types of heat treatment furnaces, in particular for the heat treatment of metallic workpieces. In an embodiment, the area of application is the defined thermochemical interaction between the furnace atmosphere and the workpieces or the workpiece surface at temperatures of above 600° C.

The use of the invention in a roller hearth furnace has shown that the supplied reaction gases can be better utilized and the conversion of the atmosphere occurs more rapidly in particular in response to a change of the composition of the treatment atmosphere. According to the invention, higher carbon levels are reached, the carbon black formation, in particular the onset of carbon black in the form of carbon black flakes on the workpiece surface is reduced and the carbon transfer on the workpiece surface is improved. The stronger mixture of the atmosphere improves the correlation between the measured carbon level and the actual carburizing effect at the workpieces. It has furthermore become evident that drawing means residues in the front region of the roller hearth furnace are able to burn off easier.

Furthermore, experiments were made on a pot furnace. For this, a charge on workpieces for comparison in a pot furnace was treated with a common ventilator at 930° C., a second charge was treated by means of the method according to the invention with propellant injection. The interior of the pot furnace had a size of approximately 900 mm in diameter and a height of 2000 mm. The propellant nozzles were disposed in the upper region of the pot furnace oriented in circumferential direction and tilted towards the horizontal.

The comparison of the experiments at the pot furnace showed that the speed of the treatment atmosphere is more even with the use of the propellant injection according to the invention than with the use of the ventilator. According to an embodiment of the invention, the carbon black formation was considerably decreased. The carburizing occurred more evenly.

The invention also provides advantages in rotary furnaces. In experiments, the retort revolution speed was raised and the metering quantity per charging process was increased so that the operational capacity to the rotary furnace was increased. The method is easy to implement so that existing furnaces can be refitted rapidly.

In an embodiment of this invention, the propellant nozzles are disposed in such a manner that the propellant jets emitted by the propellant nozzles mutually influence one another in such a manner that the atmosphere is circulated as well as possible.

It has furthermore proven to be advantageous to additionally inject a hydrocarbon carrier into the heat treatment furnace. The hydrocarbon carrier may be in liquid form. The hydrocarbon carrier can be injected together with the propellant or can be supplied via separate nozzles.

In an embodiment, the hydrocarbon carrier is injected into the heat treatment furnace under high pressure of above 50 bar. In another embodiment, the hydrocarbon carrier is injected into the heat treatment furnace under high pressure of above 100 bar. Due to the high pressure, the hydrocarbon carrier atomizes after the injection and is dispersed in the furnace atmosphere. The improved mixture of the hydrocarbon carrier with the atmosphere clearly reduces the formation of black carbon.

The injection of the hydrocarbon carrier under high pressure allows the use of liquid-phase atmosphere-forming hydrocarbons. Here, high pressure of above 200 bar and/or a pulsed introduction are particularly advantageous. Both measures achieve an improved impulse effect on the surrounding atmosphere. The invention thus also enables the use of high-order hydrocarbons.

In particular gaseous hydrocarbon carriers are supplied to the heat treatment furnace under low pressure and are distributed in the furnace chamber by means of a propellant. For this, the hydrocarbon carrier is supplied in the suction region of a propellant nozzle in such a manner that the hydrocarbon carrier is carried along and swirled by the propellant, which is injected under high pressure and with a high speed.

While the present invention has been particularly shown and described with reference to exemplary embodiments thereof, it will be understood by those of ordinary skill in the art that various changes in form and details may be made therein without departing from the spirit and scope of the present invention as defined b the following claims.

What is claimed is:

1. A method for heat-treating workpieces in a heat treatment furnace such that the treatment atmosphere reaches and maintains a temperature above 600° C., the method comprises injecting a propellant under pressure directly into the heat treatment furnace by means of at least one propellant nozzle and circulating the heat treatment atmosphere in the heat treatment furnace such that the treatment atmosphere is circulated by means of the injected propellant and inhomogeneities in the treatment atmosphere are reduced and that devices for guiding the treatment atmosphere to the propellant nozzle are not provided in the heat treatment furnace, wherein a hydrocarbon carrier is sucked into the heat treatment furnace by the propellant circulating the treatment atmosphere, the hydrocarbon carrier being supplied to the heat treatment furnace at a pressure lower than the pressure of the injected propellant for distribution in the heat treatment furnace by means of the propellant.

2. The method according to claim 1, which comprises treating the workpieces at a temperature above 750° C.

3. The method according to claim 1, which comprises circulating the treatment atmosphere only by means of the injected propellant.

4. The method according to claim 1, which comprises injecting the propellant at right angles to a longitudinal direction of the heat treatment furnace.

5. The method according to claim 1, which comprises injecting the propellant into the heat treatment furnace with a speed of above 50 m/s.

6. The method according to claim 5, which comprises injecting the propellant into the heat treatment furnace with a speed faster than the speed of sound.

7. The method according to claim 1, which comprises injecting the propellant into the heat treatment furnace with a pressure of between 2 and 20 bar.

8. The method according to claim 7, which comprises injecting the propellant into the heat treatment furnace with a pressure of between 2 and 10 bar.

9. The method according to claim 1, which comprises injecting the propellant into the heat treatment furnace in a pulsed manner.

10. The method according to claim 1, which comprises injecting nitrogen into the heat treatment furnace as propellant.

11. The method according to claim 1, which comprises injecting the propellant into the heat treatment furnace in such a manner that the ratio of the volumes of circulated treatment atmosphere to inserted propellant is greater than 10.

12. The method according to claim 11, which comprises injecting the propellant into the heat treatment furnace in such a manner that the ratio of the volumes of circulated treatment atmosphere to inserted propellant is greater than 20.

13. The method according to claim 11, which comprises injecting the propellant into the heat treatment furnace in such a manner that the ratio of the volumes of circulated treatment atmosphere to inserted propellant is greater than 25.

14. The method according to claim 1, wherein the workpieces are heat-treated in a roll hearth furnace.

15. The method according to claim 1, which comprises injecting the hydrocarbon carrier into the heat treatment furnace in gaseous form.

16. The method according to claim 1, which comprises injecting the hydrocarbon carrier into the heat treatment furnace in liquid form.

* * * * *